US006796646B2

(12) United States Patent
Komplin et al.

(10) Patent No.: US 6,796,646 B2
(45) **Date of Patent: *Sep. 28, 2004**

(54) REPLACEABLE INK CARTRIDGE FOR INK JET PEN

(75) Inventors: Steven Robert Komplin, Lexington, KY (US); Michael David Lattuca, Lexington, KY (US); Gregory Alan Long, Lexington, KY (US); David Amos Ward, Cynthiana, KY (US)

(73) Assignee: Lemark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/213,284

(22) Filed: Aug. 6, 2002

(65) Prior Publication Data

US 2003/0035035 A1 Feb. 20, 2003

Related U.S. Application Data

(60) Continuation of application No. 09/668,716, filed on Sep. 22, 2000, now abandoned, which is a division of application No. 09/413,442, filed on Oct. 16, 1999, now Pat. No. 6,155,678.

(51) Int. Cl.[7] ..... B41J 2/175; B41J 2/14

(52) U.S. Cl. ..... 347/86; 347/49; 347/87

(58) Field of Search ..... 347/19, 49, 85, 347/86, 87; 400/174, 175

(56) References Cited

U.S. PATENT DOCUMENTS

| | | | | |
|---|---|---|---|---|
| 4,408,914 A | | 10/1983 | Ciesiel et al. | |
| 4,971,463 A | | 11/1990 | Daley et al. | |
| 5,138,344 A | * | 8/1992 | Ujita | 347/85 |
| 5,245,361 A | | 9/1993 | Kashimura et al. | |
| 5,519,422 A | | 5/1996 | Thoman et al. | |
| 5,534,899 A | | 7/1996 | Uchikata et al. | |
| 5,619,237 A | | 4/1997 | Inoue et al. | |
| 5,905,518 A | | 5/1999 | DeFilippis | |
| 5,956,057 A | | 9/1999 | Childers et al. | |
| 6,102,533 A | | 8/2000 | Nozawa et al. | |
| 6,155,678 A | * | 12/2000 | Komplin et al. | 347/86 |
| 6,227,643 B1 | * | 5/2001 | Purcell et al. | 347/19 |
| 6,238,042 B1 | * | 5/2001 | Kobayashi et al. | 347/86 |

FOREIGN PATENT DOCUMENTS

| | | |
|---|---|---|
| EP | 0412 459 A2 | 2/1991 |
| JP | 1141750 | 6/1989 |
| JP | 1141752 | 6/1989 |
| JP | 05318758 | 12/1993 |

* cited by examiner

*Primary Examiner*—Anh T.N. Vo
(74) *Attorney, Agent, or Firm*—Lexmark International, Inc.

(57) ABSTRACT

The invention provides an ink jet pen including a cartridge body having a printhead and a replaceable ink cartridge removably positionable on the cartridge body. At least one cooperating elongate recess and at least one projection are located on the mutually facing surfaces of the ink cartridge and the cartridge body. The projection and recess are engageable with one another for guidably positioning the ink cartridge to a desired position relative to the cartridge body.

21 Claims, 13 Drawing Sheets

REPLACEABLE INK CARTRIDGE FOR INK JET PEN

This application is a continuation of application Ser. No. 09/668,716, filed Sep. 22, 2000, now abandoned, which is a division of application Ser. No. 09/413,442 filed Oct. 6, 1999, now U.S. Pat. No. 6,155,678, issued Oct. 6, 1999.

FIELD OF THE INVENTION

The invention relates to ink jet printers and in particular to ink jet pens and their components.

BACKGROUND OF THE INVENTION

Thermal ink jet printers are increasingly incorporating permanent or semi-permanent ink jet pens having replaceable ink cartridges. These pens are characterized as having a replaceable ink cartridge and permanent or semi-permanent components, typically a cartridge body having a TAB circuit and a printhead. The lower end of the ink cartridge usually includes an ink filter for filtering and conducting ink from the ink cartridge to the printhead. When the ink is depleted, replacing the depleted ink cartridge with a fresh ink cartridge extends the life of the pen.

It is important to the operation of the ink jet pen that the fresh ink cartridge be properly seated on the cartridge body. Otherwise, leakage of ink, introduction of air into the ink cartridge and other problems associated with replacement of the ink cartridge may result.

Accordingly, there is a need in the art for improved ink jet pen components for use with ink jet pens.

Another object of the invention is to provide an improved ink jet pen of the type having a replaceable ink cartridge.

An additional object of the invention is to provide an improved ink cartridge.

A further object of the invention is to provide devices of the character described which facilitate replacement of ink cartridges and aid in providing ink jet pens of improved reliability and performance.

Yet another object of the invention is to provide devices of the character described which are uncomplicated in configuration and convenient to use.

Still another object of the invention is to provide a method for extending the life of an ink jet pen.

Another object of the invention is to provide a method of replacing an ink cartridge on an ink jet pen.

SUMMARY OF THE INVENTION

With regard to the foregoing and other objects and advantages, the invention relates to an improved ink jet pen.

In accordance with a preferred embodiment of the invention, the pen includes a cartridge body having a printhead and a replaceable ink cartridge removably positionable on the cartridge body. Cooperating elongate recesses and projections are located on the ink cartridge and the cartridge body. The projections and recesses are engageable for guidably positioning the ink cartridge to a desired position relative to the cartridge body.

In another aspect, the invention relates to a method for replacing an ink cartridge on an ink jet pen.

In a preferred embodiment, the method includes the steps of providing a cartridge body having a printhead and a replaceable ink cartridge, the printhead and the ink cartridge having cooperating d recesses and projections engageable with one another. The ink cartridge and the cartridge body are moved relative to one another to engage the projections and recesses and seat the ink cartridge on the cartridge body so that ink within the ink cartridge is in flow communication with the printhead.

In still another aspect of the invention, the invention relates to A replaceable ink cartridge for use with an ink jet pen of the type having a semi-permanent or permanent cartridge body containing a printhead and positionable on the cartridge body.

In a preferred embodiment, the replaceable ink cartridge includes a body portion defining a reservoir and containing ink within the reservoir, an outlet port defined on the body portion and in flow communication with the reservoir, the port being placeable in flow communication with the printhead when the ink cartridge is installed on the cartridge body, and d structure substantially aligned with a substantially vertical length axis of the ink cartridge and defined on one or more exterior surfaces of the ink cartridge. The d structure of the ink cartridge is positionable during installation of the ink cartridge on a cartridge body so as to be engageable with one or more portions of the cartridge body for guidably positioning the ink cartridge to a desired position relative to the cartridge body when the ink cartridge is installed on the cartridge body.

The invention advantageously facilitates replacement of ink cartridges of ink jet pens.

BRIEF DESCRIPTION OF THE DRAWINGS

Further advantages of the invention will become apparent by reference to the detailed description when considered in conjunction with the figures, which are not to scale, wherein like reference characters indicate like elements through the several views and wherein.

DETAILED DESCRIPTION OF THE INVENTION

Figure 1:
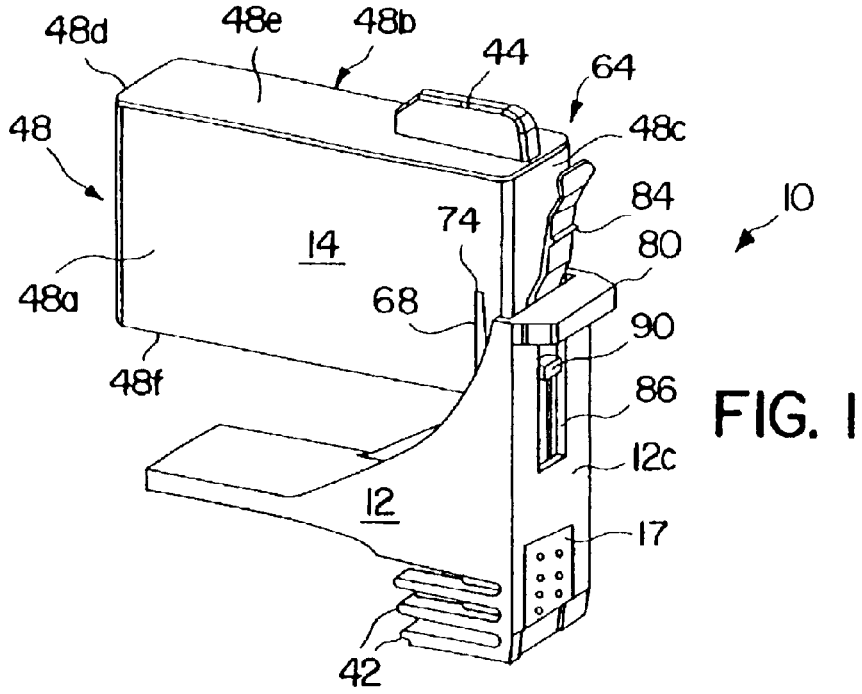
FIG. 1 is an exploded front perspective view of an ink jet pen in accordance with a preferred embodiment showing a replaceable ink cartridge being positioned on a cartridge body.

The invention relates to ink jet pens of the type having disposable components and permanent or semi-permanent components. The components of the pen are advantageously configured to facilitate replacement of the disposable components. Accordingly, and with reference to FIGS. 1–4, there is shown an ink jet pen 10 and the components thereof including a permanent or semi-permanent cartridge body 12 attachable to a replaceable ink cartridge 14 for providing ink to an ink jet printhead 16 connected to a TAB circuit, such as circuit 17.

The cartridge body 12 may be configured to hold a single ink cartridge or to hold multiple ink cartridges, preferably of different color inks. In the case of a single ink cartridge 14, the cartridge body 12 preferably contains a single printhead 16 adjacent a lowermost surface 18 of the cartridge body 12 opposite the ink cartridge 14.

In the case of multiple cartridges or multicolor cartridges, as shown in FIGS. 5–9, one or more cartridge bodies 20 may be provided and configured to contain multiple ink cartridges 22, 24, 26 and 28 and multiple printheads 30, 32, 34 and 36, connected to TAB circuits or flexible circuits 37, 38, 39 and 40.

The embodiment of FIGS. 10–13 shows a single ink cartridge having a plurality of separate ink chambers therein, preferably 3 or 4 ink chambers, each ink chamber containing a different color ink, and a cartridge body having a corresponding number of printheads, i.e., one for each ink color.

In high speed, high quality printing operations, it is preferred that the cartridge bodies be adapted to remove heat from the printheads attached thereto. This may be accomplished by constructing the cartridge body out of a heat conducting metal such as aluminum, stainless steel, zinc, and other metals and alloys and/or as by providing heat conducting fins 42 on the cartridge body 12 or fins 42' on the cartridge body 20 (FIG. 7) to conduct heat away from the printhead by conduction and convention. The ink cartridge 14 is typically made of a polymeric thermoplastic material, such as polyethylene or polypropylene, which is resistant to corrosion from exposure to ink.

Returning now to FIGS. 1–4, the replaceable ink cartridge 14 has an upper portion containing a handle 44 (or handle 46) and a body portion 48 having side surfaces 48*a* and 48*b*, front surface 48*c*, rear surface 48*d*, top surface 48*e* and bottom surface 48*f*. The handle 44 (or 46) is located on the top surface 48*e*.

An outlet conduit or port 50 is located adjacent the bottom surface 48*f* of the body portion 48 and is in flow communication with the interior of the body portion 48. The port 50 is placeable in flow communication with the printhead 16 by means of a needle valve to feed ink to the printhead. The outlet port 50 preferably includes or cooperates with a filter material, such as foam, for filtering ink as it travels from the ink cartridge 14 to the printhead 16.

Figure 3:
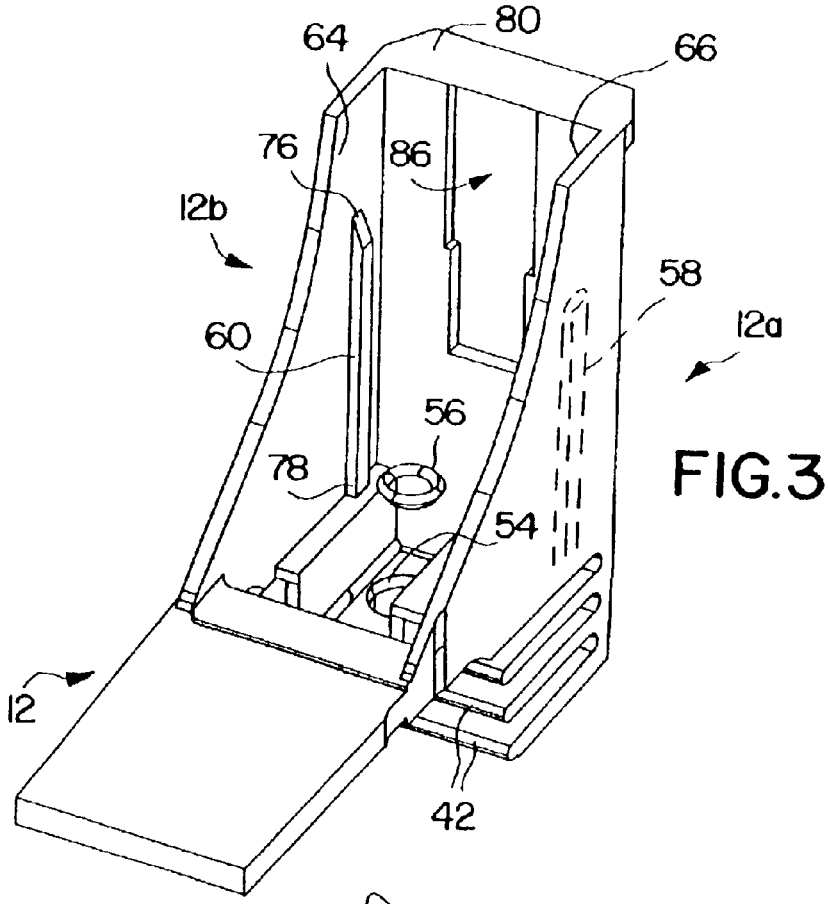
FIG. 3 is a rear perspective view of the cartridge body of the pen of FIG. 1.

The outlet port 50 may initially be sealed as by a rupturable membrane or a pre-pierced elastomeric septum. The membrane is ruptured by an ink needle during installation of the ink cartridge 14 onto the cartridge body 12 when the ink cartridge 14 is seated on the cartridge body 12 to place the ink cartridge 14 in ink flow communication with the printhead 16. The needle valve assembly, described in more detail below may be received by and seated within a recess 54 in the cartridge body 12. A seal such as O-ring 56 located at the recess 54 seals against leakage of ink when the needle valve assembly is attached to the cartridge body (FIG. 3).

Figure 2:
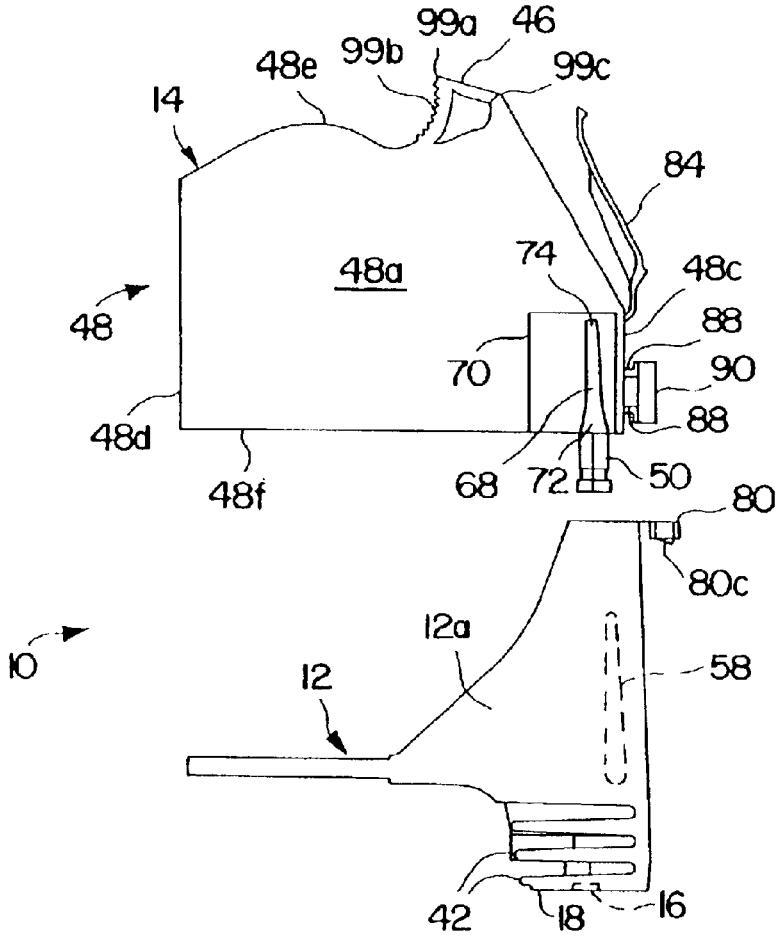
FIG. 2 is an exploded side elevational view of an ink jet pen according to the invention.

The cartridge body 12 and the ink cartridge 14 are mutually configured with engageable projections and recesses to improve the step of replacement of a depleted ink cartridge with a fresh ink cartridge. In this regard, the cartridge body 12 preferably includes projections, such as a pair of guide rails 58 and 60 thereon on opposite facing interior surfaces 64 and 66 of sides 12*a* and 12*b* of the cartridge body 12 (FIG. 3). The rails 58 and 60 are received by corresponding recesses, such as guide grooves or slots 68 on opposite exterior surfaces of sides 48*a* and 48*b* of the ink cartridge 14 (FIG. 2). The guide rails 58 and 60 and slots 68 cooperate for guiding substantially vertical or linear travel of the ink cartridge 14 as it is being installed on the cartridge body 12 as opposed to an initial angular orientation of the ink cartridge 14 with respect to the cartridge body 12 as the cartridge 14 is being inserted therein.

The substantially vertical or linear travel of the cartridge 14 facilitates installation of the ink cartridge to the body 12*a* and connection of the port 50 with recess 54 so that a substantially liquid and gas tight connection is made between the ink cartridge 14 and body 12*a*. For the purposes of the description, and without intending to limit the invention in any way, the term "vertical" with respect to the cartridge 14 or body 12*a* is intended to indicate an initial movement of the cartridge 14 in a direction substantially along an axis defined by rails 58 and 60 and/or slots 68 as the cartridge 14 is inserted in the body 12 and is not intended to indicate an absolute direction or orientation thereof. Furthermore, the term "substantially vertical" means that the ink cartridge 14 is installed on the cartridge body 12 by tilting the cartridge 14 no more than 10 degrees with respect to a vertical axis aligned with the rails 58 and 60 and slots 68. Typically the cartridge 14 is tilted no more than about 2 degrees from the vertical axis.

The slots 68 may be recessed directly into the cartridge body 14 (FIG. 1) or may be located on raised portions on the side surfaces 48*a* and 48*b*, such as raised portion 70. As will be appreciated, the slots 68 could alternatively be located on the cartridge body 12 and the rails 58 and 60 on the ink cartridge 14, or a single rail 58 or 60 may be located on one side of the cartridge body 12 and a slot 68 on an opposite side thereof, with the corresponding sides of the ink cartridge 14 having a rail and/a slot to cooperate with the slot and rail on the cartridge body 12.

The slots 68 are preferably tapered and include a relatively wide first end 72 having a width of from about 5 to about 8 millimeters and a relatively narrower second end 74 having a width of from about 3 to about 5 millimeters. The overall length of each of the slots 68 is preferably from about 30 to about 60 millimeters. The rails 58 and 60 are similarly configured so as to be fittingly and slidingly receivable within the slots 68. Each rail 58 and 60 preferably includes a relatively narrower and tapered first end 76 and a relatively wider second end 78. The relative width of the first end 72 facilitates positioning of the rails therein, with the relatively narrow first end 76 of the rails being initially positioned therein. The rails and slots cooperate to provide a snug fit when the rails 58 and 60 are fully positioned within the slots 68 so as to maintain the ink cartridge 14 in a preferred alignment with the cartridge body 12 without additional securement. However, additional securement may be included if desired.

In this regard, front side 12*c* of the cartridge body 12 which is connected to sides 12*a* and 12*b*, may include a projection 80 extending outwardly and perpendicular therefrom for engaging a latch member 84 of the ink cartridge 14. An elongate slot or recess 86 may also be located, preferably centrally located, on the front side 12*c* to provide space for placement of memory support arms 88 extending from front surface 48*c* of the ink cartridge 14 and a memory device 90 attached, as by adhesive to the support arms 88, for receiving, storing and/or transmitting alignment information, ink information, and the like to a printer control system.

Figure 4:
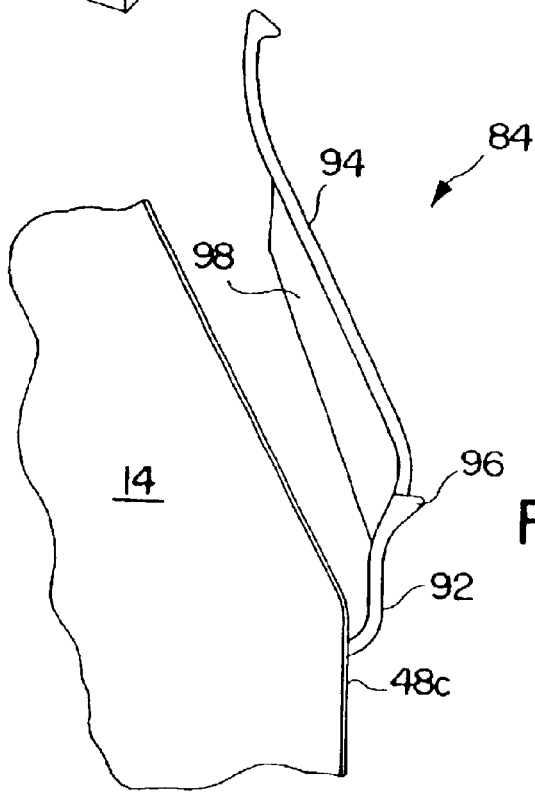
FIG. 4 is an enlarged side view of a latching member portion of an ink cartridge of the pen of FIG. 2.
Figure 5:
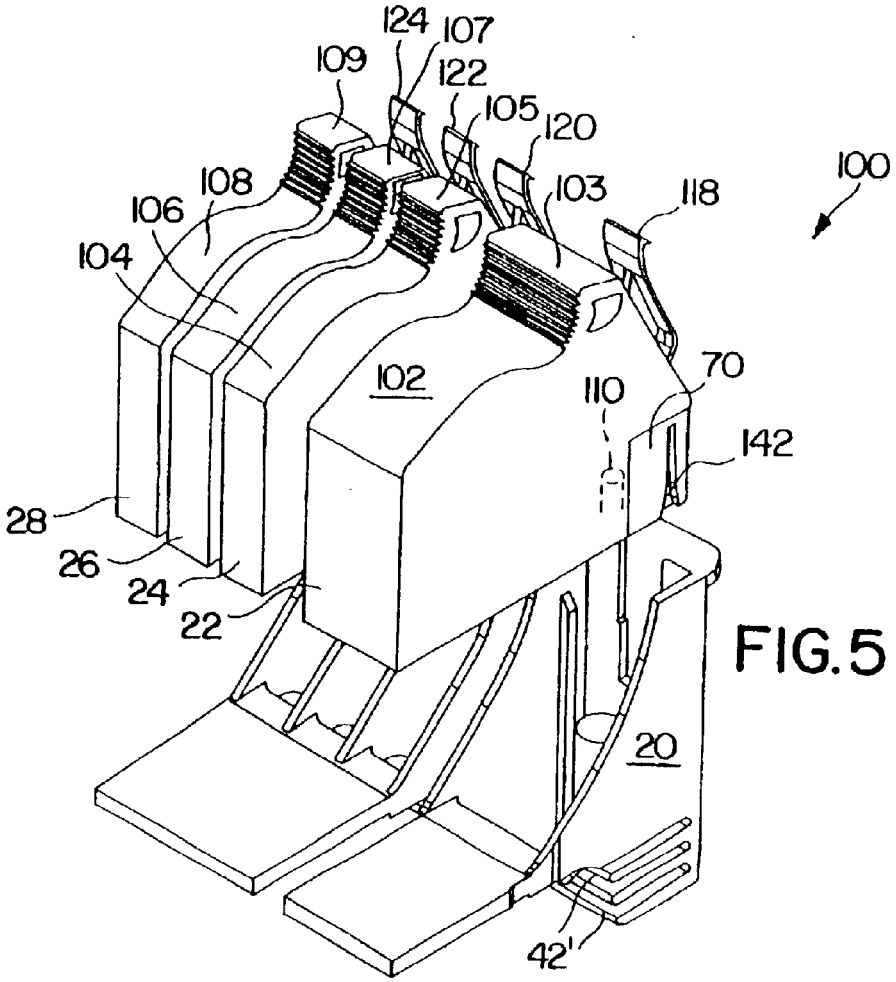
FIG. 5 is an exploded rear perspective view of an ink jet pen in accordance with the invention having multiple ink cartridges.
Figure 6:
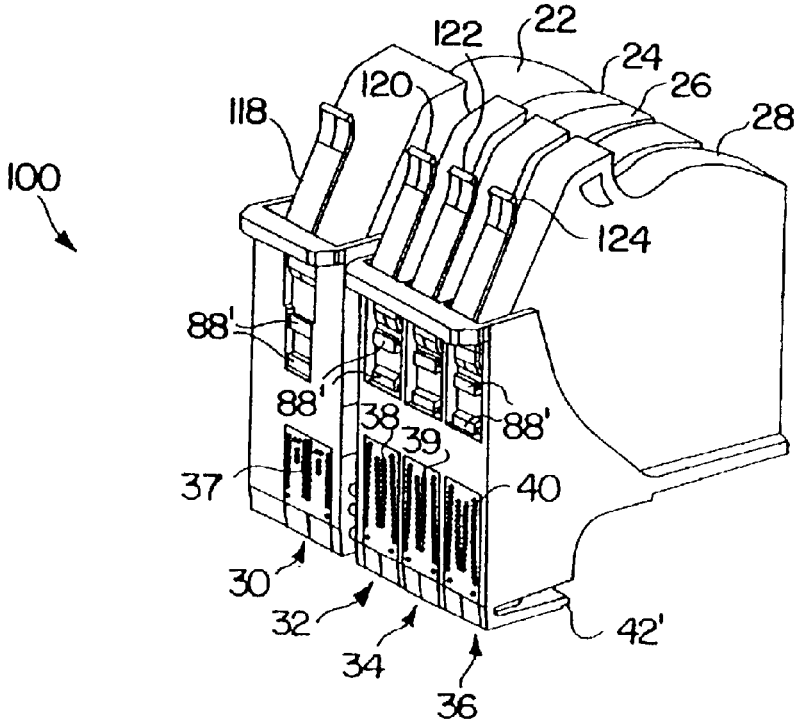
FIG. 6 is a front perspective view of the pen of FIG. 5 having the ink cartridges installed on cartridge bodies.

As best seen in FIG. 4, the latch member 84 preferably includes a lower leg portion 92 attached to the front surface 48*c* and extending outwardly therefrom. An upper lever portion 94 extends upwardly from an uppermost part of the leg portion 92 in a direction generally toward the handle 44 or 46. An outwardly extending finger 96 located on the front of the latch member 84 adjacent the juncture of the leg portion 92 and the lever portion 94 is engageable with a lower surface 80*c* of the projection 80 for removable attachment of the ink cartridge 14 to the cartridge body 12. A reinforcing member 98 preferably extends between the leg portion 92 and the lever 94 for strength. The leg portion 92 is biasable toward the front surface 48*c* by application of pressure to the lever portion 94 in a direction toward the handle 44 or 46. In this manner, the latch member 84 can be positioned to yieldably engage the lower surface 80*c* of projection 80 for additional securement of the ink cartridge 14 on the cartridge body 12.

An advantage achieved by the invention is the enablement of one-handed installation and removal of the ink cartridge 14 from the cartridge body 12. The configuration of the handle 44 or 46 compliments this feature and in a preferred embodiment includes a curved rear surface 99*a* having textured surfacing or knurls 99*b* and aperture 99*c* extending through the thickness of the handle 46. As will be appreciated, a user may insert an appendage, such as a finger, into the aperture 99*c* and bear another appendage, such as a finger or thumb, against the knurls 99*b* of rear surface 99*a* in order to securely hold the cartridge 14 during installation and removal procedures.

Turning now to FIGS. 5–9, there is shown another embodiment of an ink jet pen 100 in accordance with the invention and having multiple ink cartridges and multiple cartridge bodies, each body containing at least one printhead. As described above, the pen 100 includes cartridge body 20, ink cartridges 22, 24, 26 and 28 and printheads 30, 32, 34 and 36, connected to TAB circuits or flexible circuits 37, 38, 39 and 40.

Each ink cartridge 22, 24, 26 and 28 is preferably substantially similar in configuration to the ink cartridge 14. Accordingly, cartridge 22 includes a body portion 102 having a handle 103 outlet port 110 and latch member 118. Cartridges 24, 26 and 28 are similarly configured and include body portions 104, 106 and 108, handles 105, 107 and 109, outlet ports 112, 114 and 116, and latch members 120, 122 and 124, respectively. The ports 110–116 may be received within recesses 54' on the cartridge body 20 in the manner described for port 50 being received into recess 54 and having an associated seal such as an o-ring 56 (FIG. 3).

Figure 7:
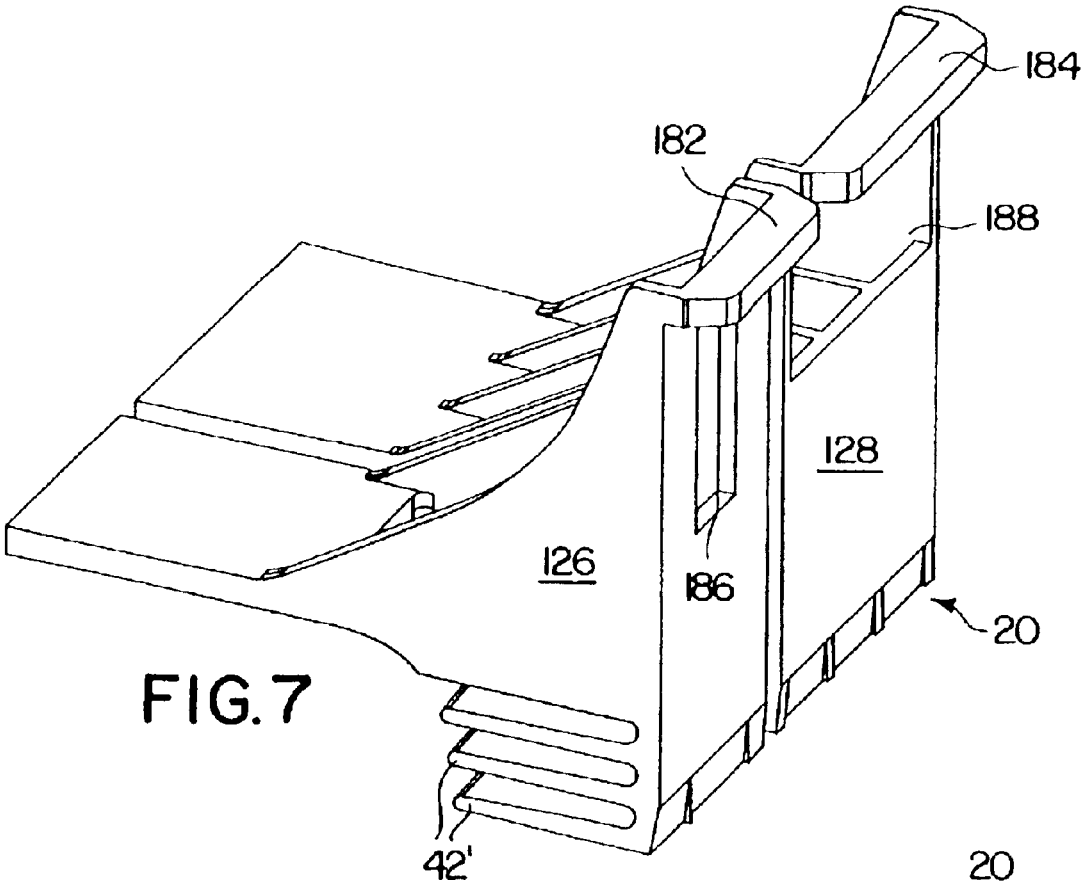
FIG. 7 is a perspective view of the cartridge body of the pen of FIG. 5.
Figure 8:
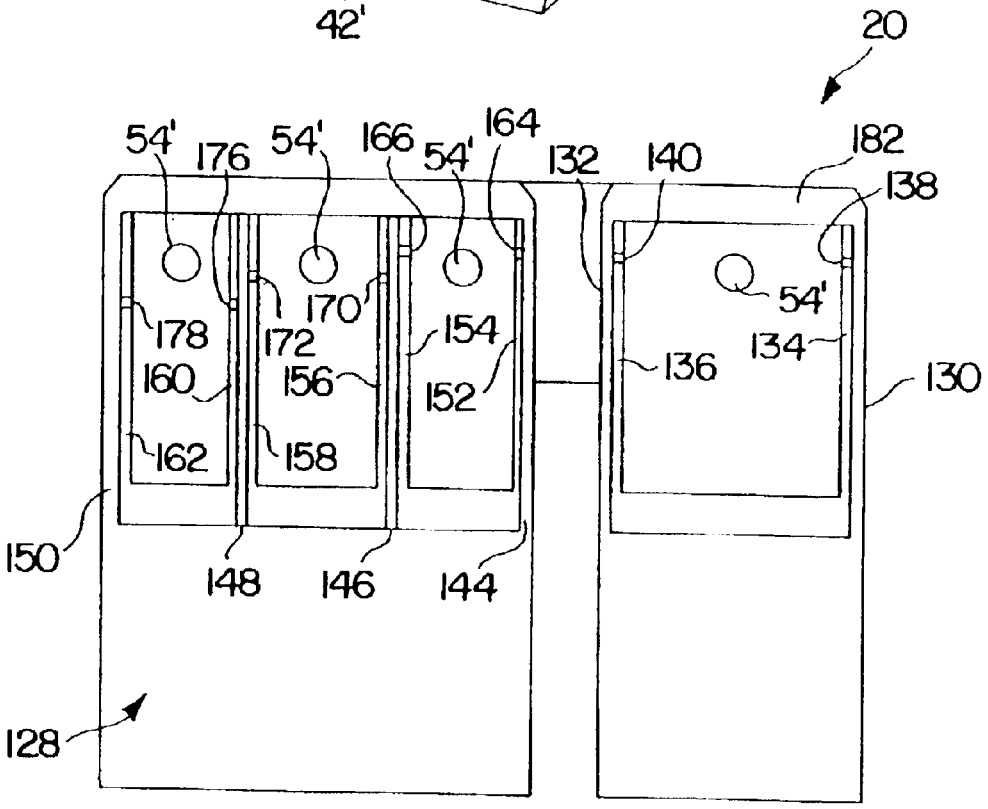
FIG. 8 is a top plan view of the cartridge body of FIG. 7.

With further reference to FIGS. 7 and 8, the cartridge body 20 includes a body portion 126 configured to receive ink cartridge 22 and a body portion 128 configured to receive the ink cartridges 24, 26 and 28. The body portions 126 and 128 may be separate or are preferably rigidly connected to one another as by fins 42'.

The body portion 126 includes sidewalls 130 and 132 having mutually facing interior surfaces 134 and 136, respectively, between which the ink cartridge 22 is positionable. Rails 138 and 140 (configured similar to rails 58 and 60) are located on surfaces 134 and 136, respectively, for receiving corresponding slots 142 (configured similar to slots 68), one each being on opposite sides of the cartridge body.

Figure 9:
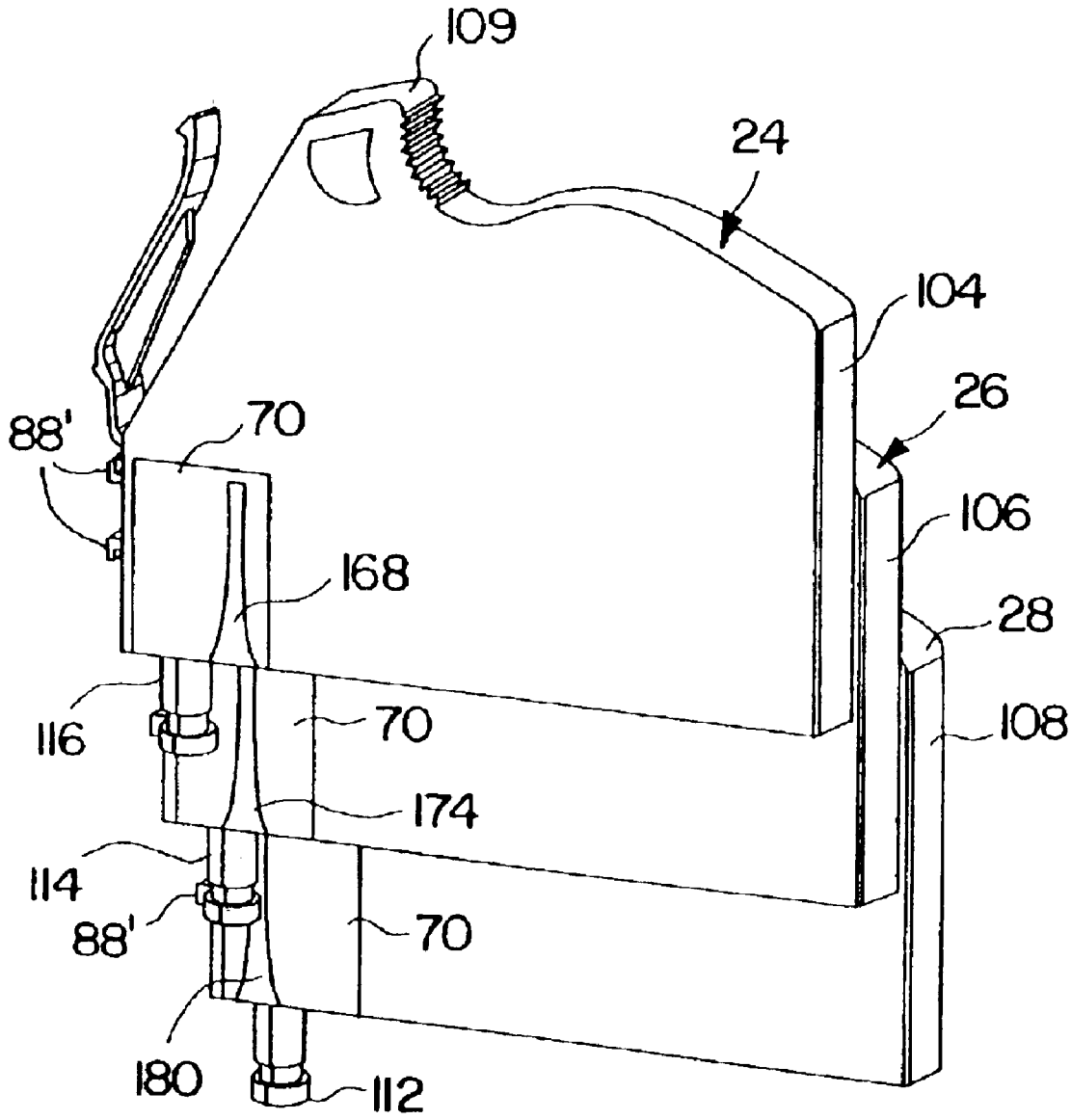
FIG. 9 is a side perspective view of ink cartridges of the pen of FIG. 5.
Figure 10:
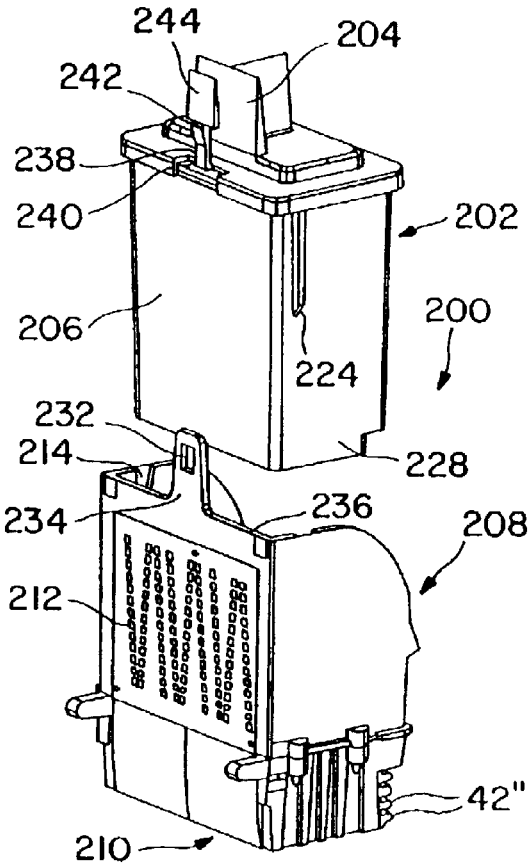
FIG. 10 is an exploded front perspective view of an ink jet pen in accordance with another embodiment of the invention.
Figure 11:
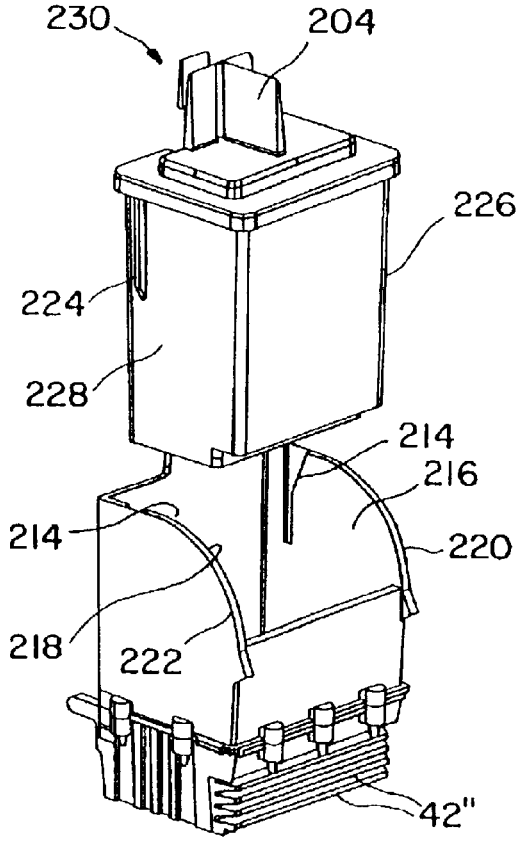
FIG. 11 is a rear exploded view of the pen of FIG. 10.
Figure 12:
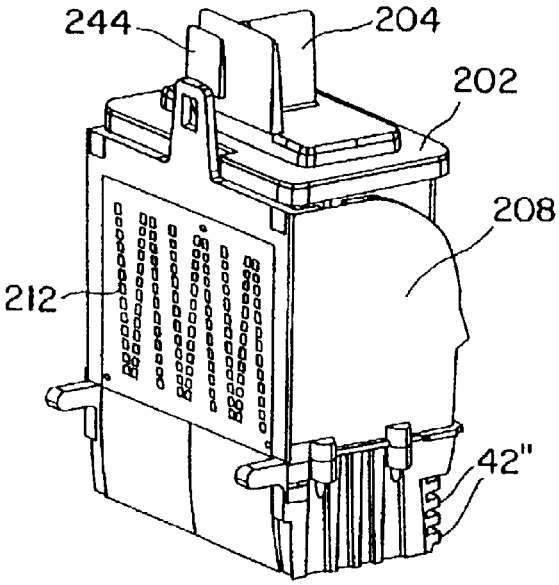
FIG. 12 is a front perspective view of the pen of FIG. 10 in an assembled state.
Figure 13:
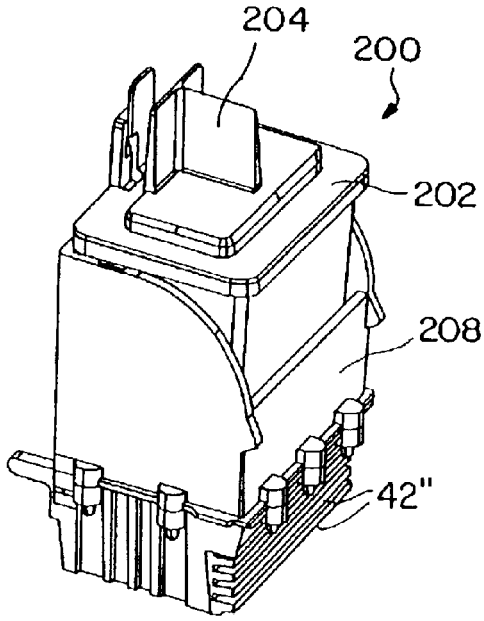
FIG. 13 is a rear perspective view of the pen of FIG. 12.

Similarly, body portion 128 includes sidewall 144, 146, 148 and 150. Ink cartridge 24 is positionable between surface 152 of sidewall 144 and surface 154 of sidewall 146. Ink cartridge 26 is positionable between surface 156 of sidewall 146 and surface 158 of sidewall 148. Ink cartridge 28 is positionable between surface 160 of sidewall 148 and surface 162 of sidewall 150. Rails 164 and 166 (configured similar to rails 58 and 60) are located on surfaces 152 and 154 for receiving corresponding slots 168 (configured similar to slots 68), one each being on opposite sides of the cartridge body 24 (FIG. 9). Similarly configured rails 170 and 172 are located on surfaces 156 and 158 for receiving corresponding slots 174 on opposite sides of the cartridge body 26 and rails 176 and 178 are located on surfaces 160 and 162 for receiving corresponding slots 180 on opposite sides of the cartridge body 28.

With reference to FIG. 9, the slots 168, 174 and 180 are preferably staggered or offset from one another. The corresponding sets of rails 164 and 166, 170 and 172, and 176 and 178 are likewise staggered or offset so that they are not aligned with one another in a single plane parallel each set of rails. This advantageously prevents undesirable mis-seating of the ink cartridges in the wrong position with respect to a corresponding printhead. For example, the ink cartridges 24, 26 and 28 preferably contain inks of different color. Improper placement of the ink cartridges with respect to the printheads would thus cause the wrong color ink to be dispensed through the printheads. The provision of the slots and rails such that each ink cartridge can only be received in the space of the cartridge body having rails that correspond in alignment with the slots on the ink cartridge will accordingly prevent accidental mis-seating of an ink cartridge in the wrong position.

Body portion 126 also includes projection 182 and body portion 128 includes projection 184 (FIG. 7); each preferably configured similar to projection 80 for engaging latch members 118, 120, 122 and 124 of the ink cartridges 22, 24, 26 and 28. Each latch member 118–124 may be similar in configuration to the latch member 84. Elongate slots or recesses 186 and 188 are centrally provided on the front surfaces of the body portions 126 and 128 to provide space for placement of memory support arms 88' (FIG. 9) and memory devices associated therewith in the manner previously described for support arms 88 and memory device 90.

FIGS. 10–13 show another embodiment of a pen 200 in accordance with the invention. The pen 200 includes a replaceable ink cartridge 202 having a handle 204 and a body portion 206. The ink cartridge 202 preferably includes several ink chambers therein, each ink chamber containing a different color ink. Preferably, the ink cartridge 202 contains three or four ink chambers.

The body portion 206 of the ink cartridge 202 is seatable within a cartridge body 208. The cartridge body has fins 42" and a plurality of to printheads, as indicated by arrow 210 connected to a TAB circuit or flexible circuit 212, it being understood that the number of printheads corresponds to the number of ink chambers or colors of ink, with one printhead being provided for each ink color. A suitable outlet port and filter is likewise provided to place each ink chamber in ink flow communication with each printhead.

Slots 214, corresponding to the slots 68, are provided on oppositely facing inner surfaces 216 and 218 of sidewalls 220 and 222. The slots 214 receive rails 224, corresponding to rails 58 and 60, located on opposite sides 226 and 228 of the body portion 206.

A latch member 230 is preferably located on an upper portion of the body portion 206 for cooperating with an aperture 232. Aperture 232 extends through an extension 234 projecting upwardly from an uppermost portion of a front sidewall 236 of the cartridge body 208. The latch member 230 includes a yieldably biased leg portion 238 that extends upwardly from upper surface 240 of the ink cartridge 202. A ledge 242 located at the uppermost end of the leg portion 238 is configured to engage the aperture 232. A contact surface 244 extends upwardly from the leg portion 238 adjacent the ledge 242 for being manipulated by a user to urge the ledge 242 away from the aperture 232.

Figure 14:
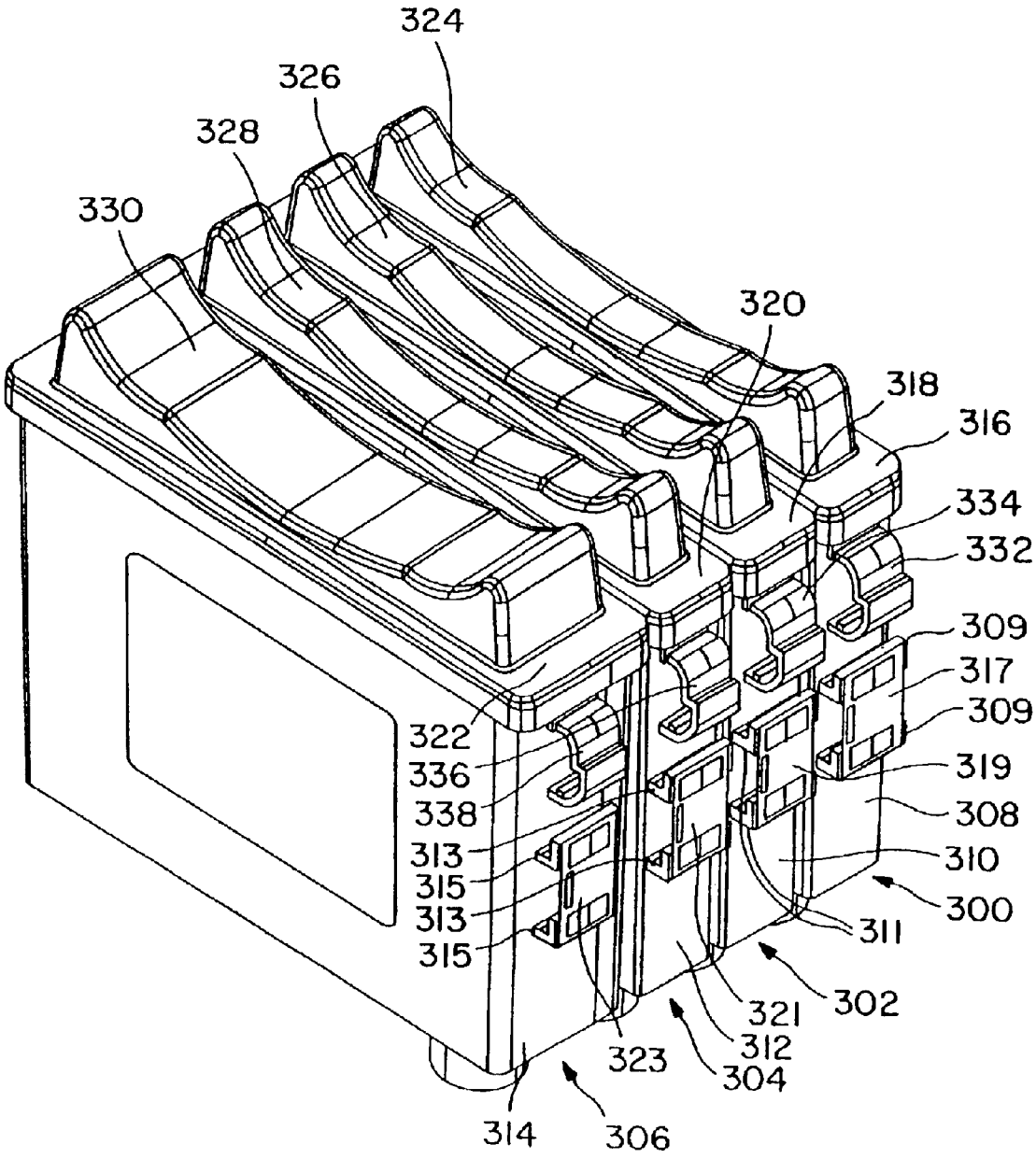
FIG. 14 is front perspective view of ink cartridges for an ink pen in accordance with another embodiment of the invention.
Figure 15:
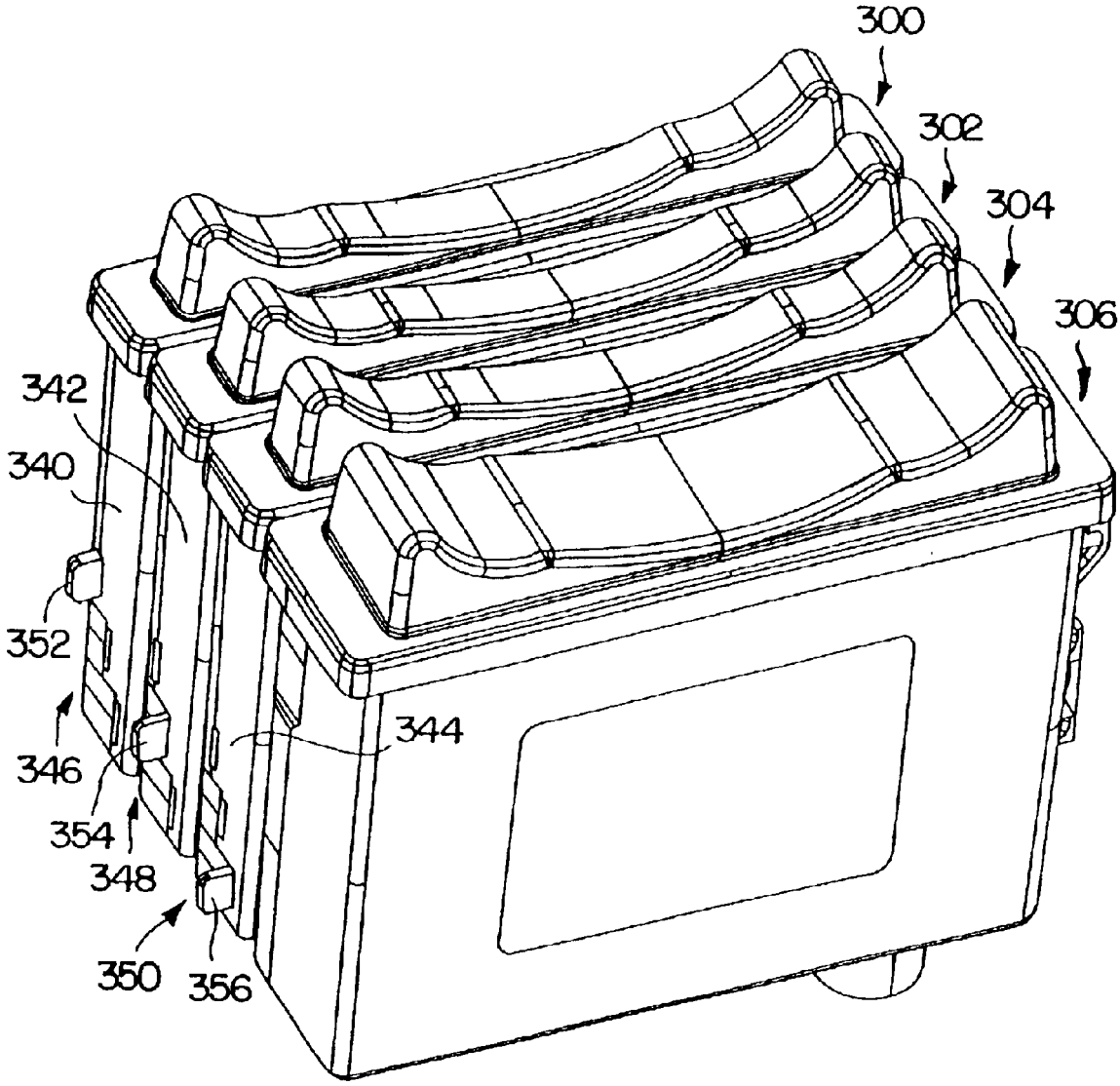
FIG. 15 is a rear perspective view of the ink cartridges of FIG. 14.
Figure 16:
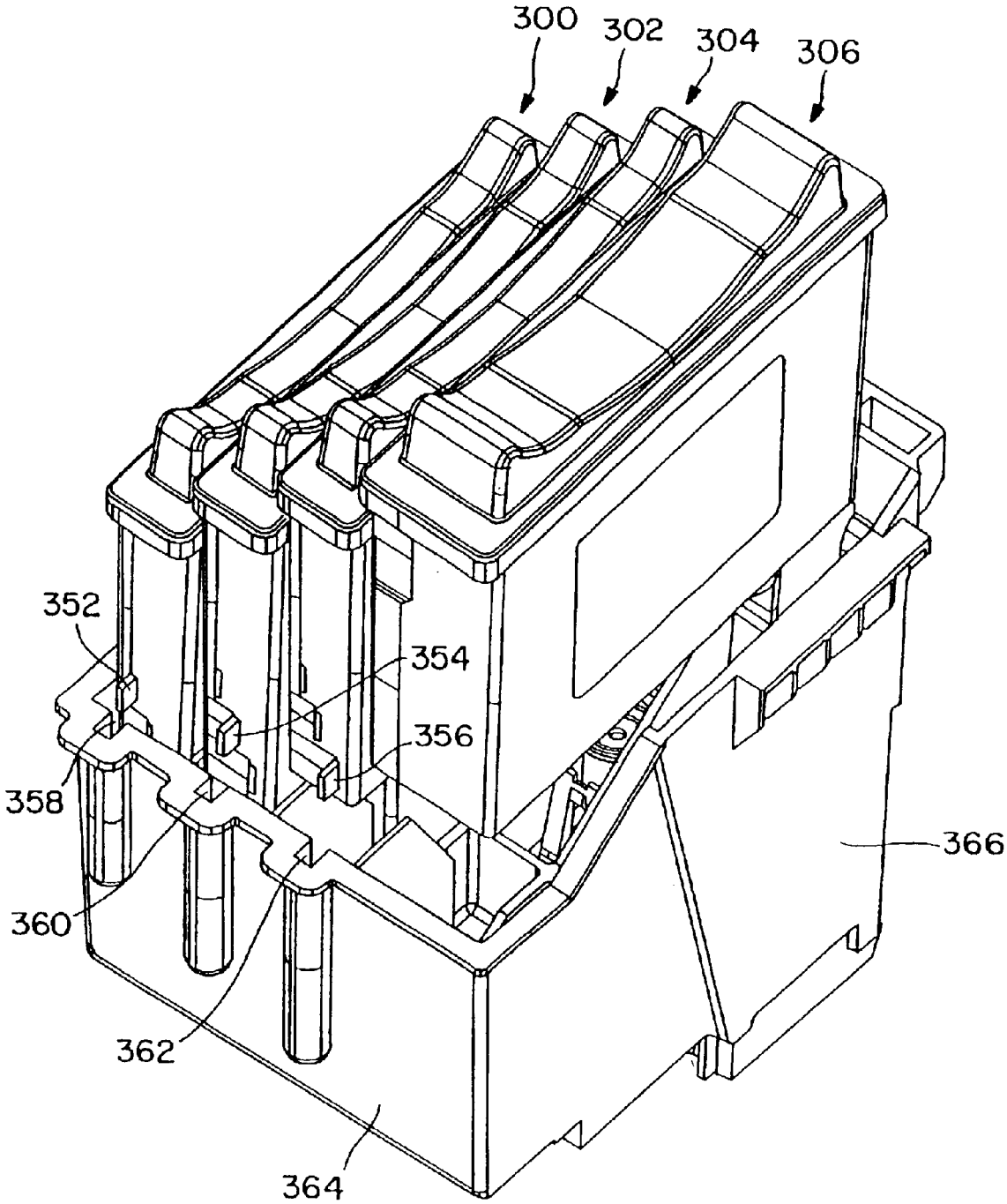
FIG. 16 is a rear exploded view in perspective of the ink pen of FIG. 16.

FIGS. 14–18 depict yet another embodiment of the ink jet pen according to the invention. With reference to FIGS. 14 and 15, the ink cartridges 300, 302, 304, and 306 have body portions containing front panels 308, 310, 312 and 314 and top panels 316, 318, 320 and 322 containing handles 324, 326, 328 and 330. Each of the front panels 308, 310, 312 and 314 contains a pair of memory support arms 309, 311, 313 and 315 for attachment thereto of memory modules 317, 319, 321 and 323 and latch members or fingers 332, 334, 336 and 338 for engaging latch portions on the cartridge body as described in more detail below.

The rear panels 340, 342 and 344 of the body portions of ink cartridges 300, 302 and 304 preferably contains keys 346, 348 and 350 which are associated with the color ink in the cartridges for correctly positioning the cartridges in an ink jet pen. Ink cartridge 306 is preferably a black ink cartridge having a larger reservoir than the reservoirs associated with the cartridges for cyan, magenta and yellow. Accordingly, there is no need to key cartridge 306 to a particular position since it only fits in one position in the ink jet pen. However, if desired, ink cartridge 306 may also be keyed to a position in the ink jet pen.

The keys 346, 348 and 350 preferably contain one or more elongate substantially rigid projections 352, 354 and 356 which extend outwardly from panels 340, 342 and 344 respectively. The horizontal position, vertical position and/or width of the projections 352, 354 and 356 may be varied to mate with elongate slots 358, 360 and 362 in a rear panel 364 of the cartridge body 366. The length, width and/or position of the slots 358, 360 and 362 preferably vary for each color cartridge to assure that the projections 352, 354 and 356 cooperatively engage the slots when the cartridge is correctly positioned and inserted in the cartridge body 366.

During insertion and attachment of the ink cartridges 300, 302, 304 and/or 306 into the cartridge body 366, the cartridges 300, 302, 304 and/or 306 are initially inserted into the cartridge body 366 in a substantially vertical or linear direction as defined above, as opposed to initially orienting the cartridges at an angle of greater than about 10 degrees with respect to the cartridge body. Accordingly, the projections 352, 354 and 356 are also linearly guided by elongate slots 358, 360 and 362 on the cartridge body 366 as the cartridges are initially inserted therein.

Figure 17:
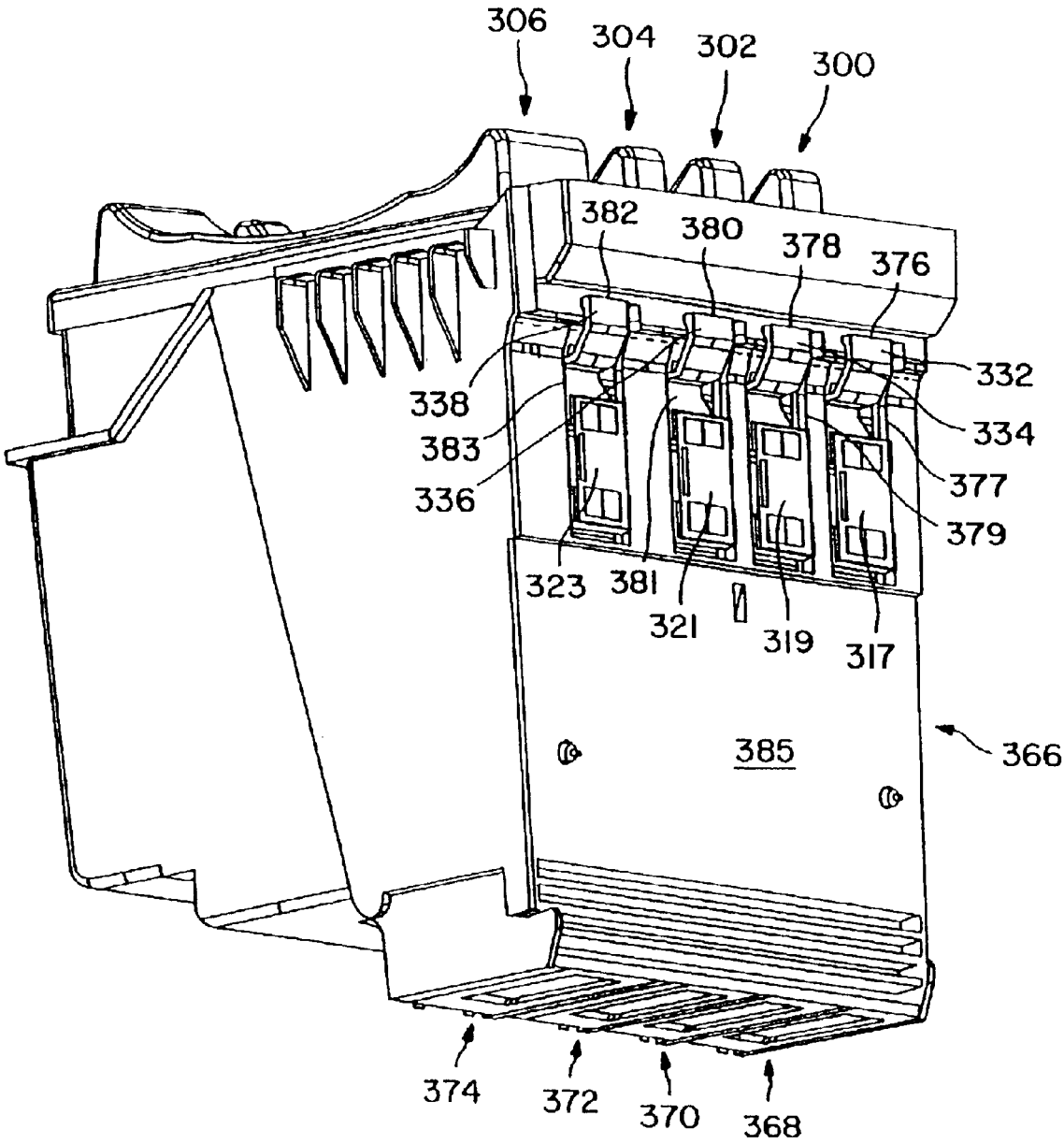
FIG. 17 is a front perspective view of an ink pen containing the ink cartridges of FIG. 14.
Figure 18:
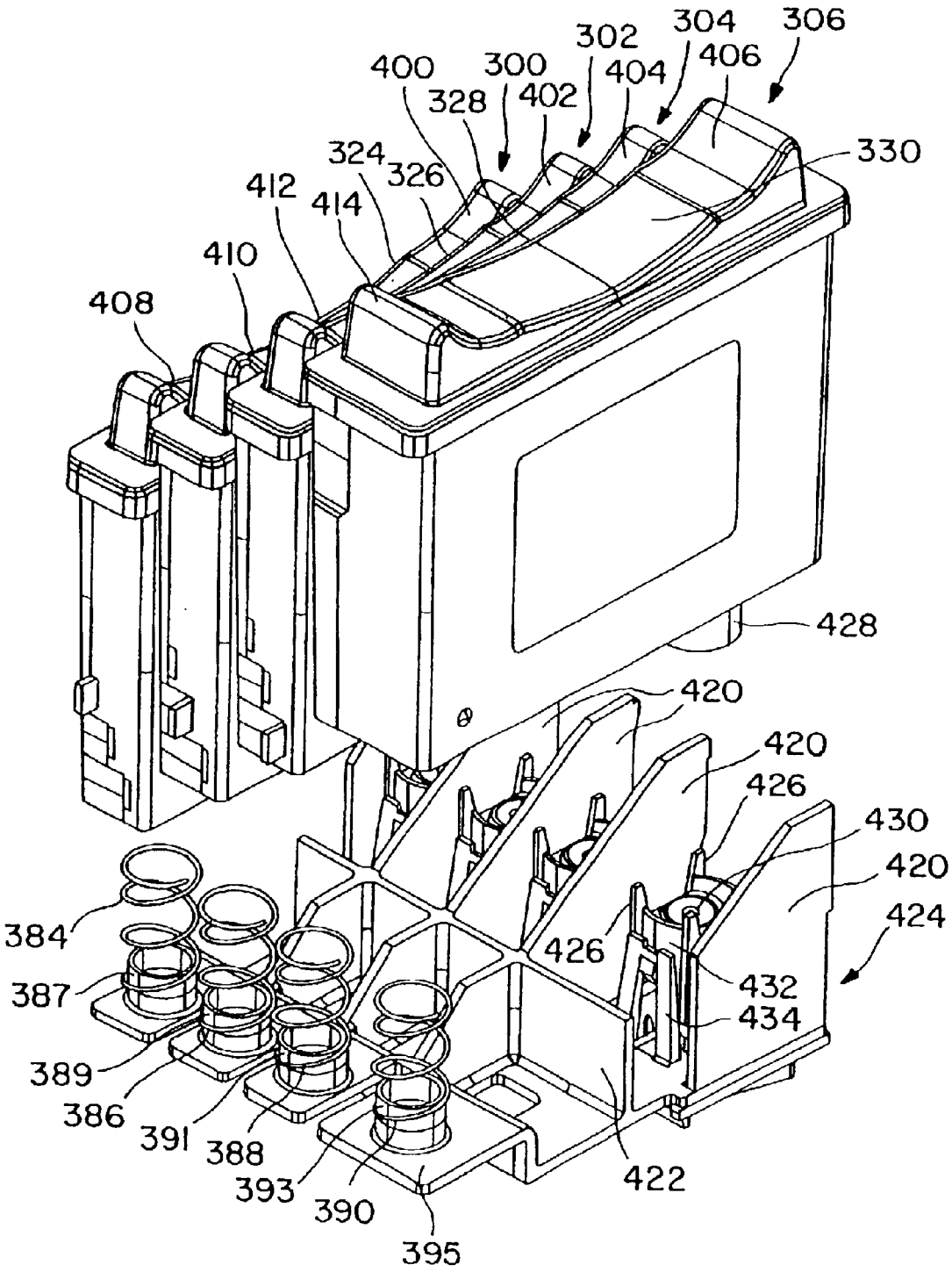
FIG. 18 is an exploded cut-away view of the ink pen of FIG. 16.

Turning now to FIGS. 17 and 18, the latching mechanism for securing the ink cartridges 300, 302, 304 and 306 to the cartridge body 366 for feeding ink to printheads 368, 370, 372 and 374 will now be described. As described above, each of the front panels 308, 310, 312 and 314 of the cartridges 300, 302, 304 and 306 contain a latch member or finger 332, 334, 336 or 338 which engages a corresponding latch portion 376, 378, 380 or 382 of the body portion 366. The front panels also contain of memory support arms 309, 311, 313 and 315 (FIG. 14) holding memory modules 317, 319, 321 and 323. As the cartridges 300, 302, 304 and 306 are vertically positioned and inserted onto the cartridge body 366, the memory modules and support arms and fingers slide into position in slots 377, 379, 381 and 383 on the front panel 385 of the cartridge body 366 so that the memory modules are exposed for electrical connection to the printer. The latch portion 376, 378, 380 and 382 of the cartridge body 366 may be a shelf or shoulder for engaging the latch members 332, 334, 336 and 338 of the cartridges. It is preferred that the latch members be substantially rigid fingers, however, resiliently biased fingers may also be used. An additional advantage of the support arms for the memory modules is that it may help guide the cartridges 300, 302, 304 and 306 onto the cartridge body 366 as the fingers and latch portions are engaged.

In order to securely engage the fingers 332, 334, 336 and 338 with the latch portions 376, 378, 380 and 382, it is preferred to bias the ink cartridges 300, 302, 304 and 306 so that there is a frictional engagement between the fingers and latch portions. The ink cartridges may be biased as by biasing members or springs 384, 386, 388 and 390 which may be attached to either the cartridge body or to the ink cartridges. The biasing members may be made of a variety of materials and have a variety of shapes including, but not limited to, coil springs, resilient foam bodies, leaf springs, and the like. It is particularly preferred to locate the biasing members 384, 386, 388 and 390 toward an end of the cartridge or cartridge body opposite the latch portions 376, 378, 380 and 382. In order to engage the latch members with the latch portions, pressure is exerted on portion 400, 402, 404 and 406 of handles 324, 326, 328 and 330 as the cartridges are inserted into the cartridge body. In order to release the latch members from the latch portions, pressure is exerted on portions 408, 410, 412 and 414 of handles 324, 326, 328 and 330, thereby depressing biasing members 384, 386, 388 and 390 an amount which is effective to release fingers 332, 334, 336 and 338 from latch portions 376, 378, 380 and 382.

In FIG. 18, the biasing members 384, 386, 388 and 390 are shown attached to cylindrical projections 387, 389, 391 and 393 which are formed as part of or attached to a lower portion 395 of the cartridge body 366. The location of the biasing members 384, 386, 388 and 390 is not critical to the invention and as such may the biasing members may be located on an upper side portion or the rear panel 364 of the cartridge body 366 or in corresponding locations on the ink cartridges themselves.

The cartridge body 366 preferably contains parallel stiffener ribs 420 which are disposed between each cartridge and assist in guiding the ink cartridges onto the cartridge body. Transverse stiffener rib 422 perpendicular to ribs 420 may also be used to maintain a cartridge body width sufficient to easily insert cartridges therein. Stiffener ribs 420 and 422 are preferably included on an stiffener insert 424 which may be inserted into the cartridge body 366 during manufacture thereof. It is particularly preferred to include the biasing members 384, 386, 388 and 390 on the insert 424 as well as boss location guides 426 for guiding the ink outlet boss 428 on the ink cartridge in connecting relationship with ink needle valve assembly 430 on insert 424. The ink needle valve assembly includes a valve slide member 432 containing a valve and a slide member guide 434 for slidably guiding the slide member 432 during the cartridge insertion step.

Pens in accordance with the invention advantageously facilitate replacement of depleted ink cartridges and aid in avoiding problems commonly encountered when replacing ink cartridges. For example, the rails and slots provided on the ink cartridge and cartridge body cooperate to guide the depleted ink cartridge directly away from the cartridge body so as to avoid bending or skewing of the sealing member and other components of the pen. Likewise, when installing a fresh ink cartridge, the rails and slots cooperate to guide the ink cartridge in substantially linear line of travel onto the cartridge body. This likewise avoids stresses on the components such as bending and the like which can degrade or damage the components and cause liquid or gas leakage. Avoiding misalignment of the port that conducts ink from the cartridge also helps to avoid introducing air into the ink cartridge during seating of the cartridge, and/or prevents damage to the seal components of the cartridge body.

Figure 19:
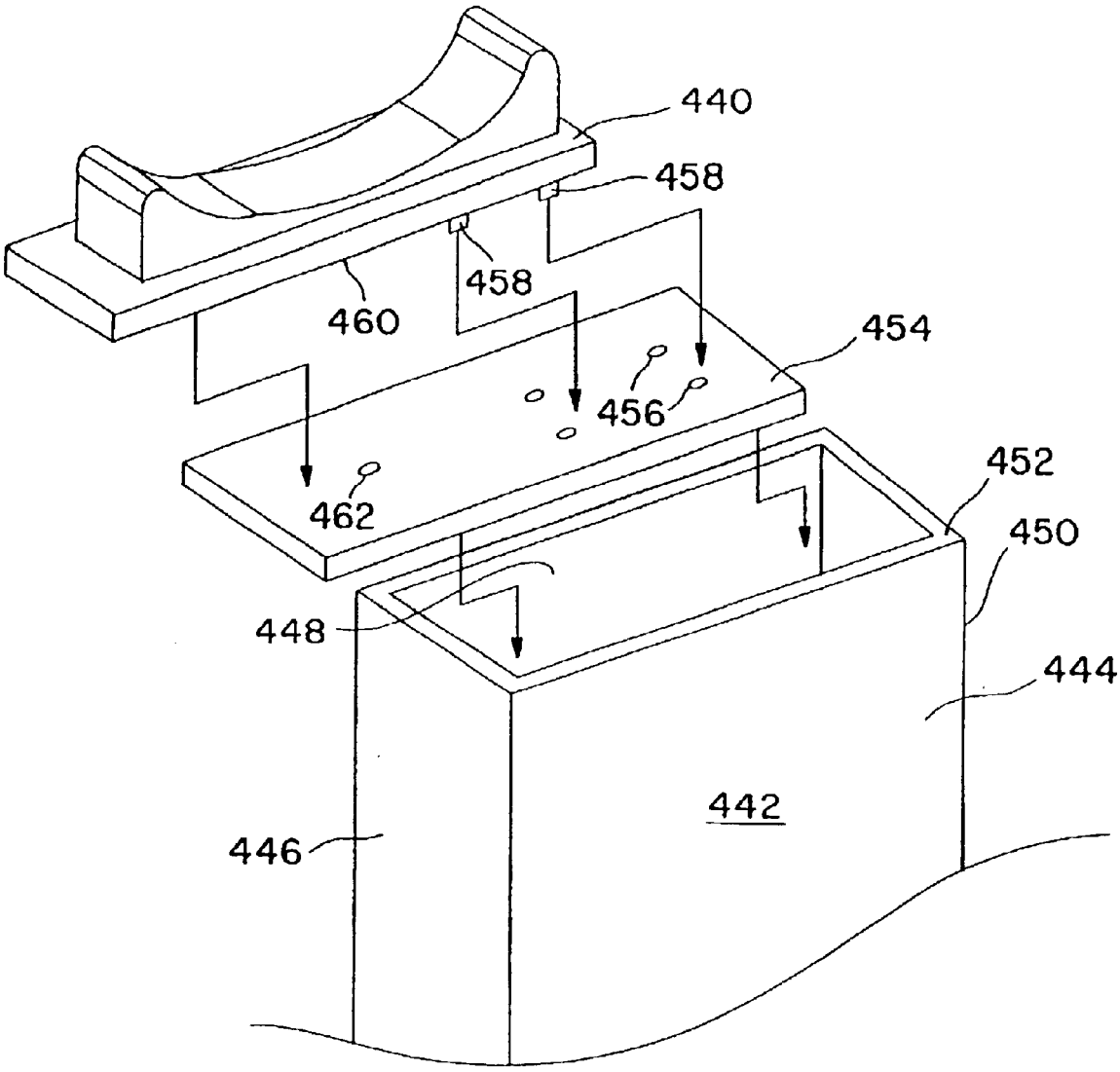
FIG. 19 is an exploded view in perspective of an ink cartridge refilling system.

In each of the embodiments described above, the ink cartridges contain an initial supply of ink and are adapted to be replaceable once the ink supply in the cartridges is depleted. In another alternative embodiment, ink may be resupplied to one or more cartridges by a variety of means. For example, with reference to FIG. 19, the cap or cover 440 of the ink cartridge 442 may be removable rather than fixedly attached to the cartridge side wall portions 444, 446, 448 and 450 around the upper periphery 452 of the cartridge 442 so that the cartridge may be refilled with ink. In order to assist in removing and replacing the caps or covers 440, the caps or covers may include an adapter 454 containing one or more apertures 456 for engagement with one or more posts or projections 458 pending from the underside 460 of cover 440. In this embodiment, the adapter 454 is fixedly attached to the upper periphery 452 as by welding or adhesives and the cover 440 is removable attached to the adapter 454. Upon removal of the cover, ink may be inserted into the cartridge 442 through one or more apertures 456 or ink fill aperture 462.

Figure 20:
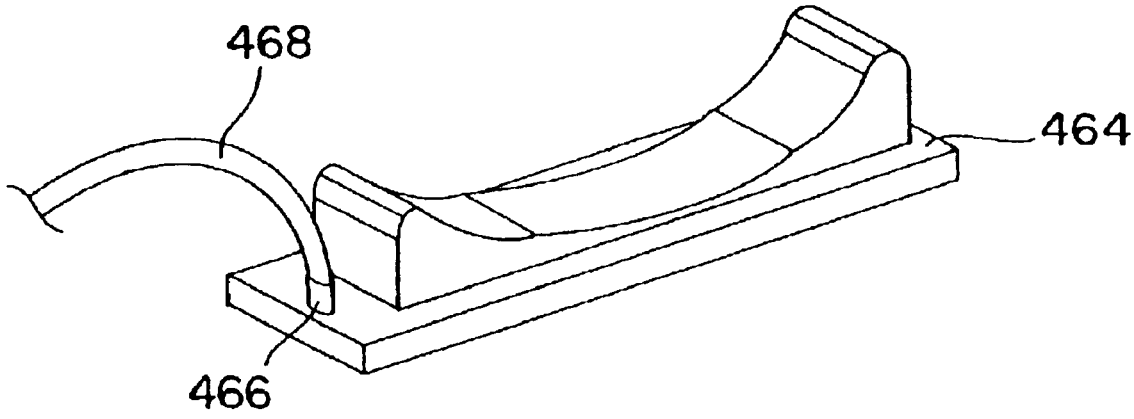
FIG. 20 is a perspective view of an ink cartridge cover containing an adapter for refilling the cartridge with ink according to the invention.

In yet another alternative, the cover 440 may be replaced by a cover 464 (FIG. 20) containing an ink inlet port 466 which may be attached to a supply conduit 468 for continuous or periodic refilling of the ink cartridge 442 with ink from an ink reservoir. In this embodiment, the cover 464 may be fixedly attached directly to the upper periphery 452 of the ink cartridge 442 (FIG. 19) without the need for adapter 454. The remote ink reservoir may be contained within the printer itself or in an ink container separate from and attached by means of an ink feed conduit to the printer. It is preferred, however, that the remote ink reservoir not be attached to the movable carriage for moving the cartridge body and ink cartridge during a printing operation.

The foregoing description of certain embodiments of the invention has been provided for the purposes of illustration only, and it is understood that various modifications or alterations may be made without departing from the spirit and scope of the invention as set forth in the following claims.

What is claimed is:

1. An ink jet pen comprising a cartridge body having a printhead and a replaceable ink cartridge, said ink cartridge and cartridge body containing at least one elongate recess having an axis parallel to the length of the recess and at least one elongate projection, said recess and projection being located on mutually racing surfaces of the cartridge and cartridge body, wherein the at least one projection and the at least one recess are engageable with one another for guidably positioning the ink cartridge to a desired position relative to the cartridge body along an guiding axis which is at least initially parallel with the recess axis, and wherein said elongate recess has a variable width, the recess width varying from a first portion of said elongate recess to a second portion of said elongate recess, said elongate projection has a variable width, the projection varying from a first end of said elongate projection to a second end of said elongate projection, and a latch member connected to the ink cartridge for engaging a portion of the cartridge body for maintaining the ink cartridge in the desired position relative to the cartridge body.

2. The ink jet pen of claim 1 further comprising an urging member for urging said latch member in latching engagement with said portion of said cartridge body.

3. The ink pen of claim 1 wherein said at least one recess comprises an elongate slot, said slot extending from a first portion of the ink cartridge toward a second portion of the ink cartridge and said at least one projection comprises a raised elongate projection, said projection extending from a second portion of the cartridge body toward a first portion of the cartridge body.

4. The ink pen of claim 3 wherein the width of said elongate slot adjacent the first portion of the ink cartridge is greater than the width of the elongate slot adjacent the second portion of the ink cartridge, and the width of the elongate projection adjacent the second portion of the cartridge body is greater than the width of the elongate projection adjacent the first portion of the cartridge body.

5. The ink pen of claim 1 wherein said at least one recess comprises an elongate slot, said slot extending from a second portion of the cartridge body toward an first portion of the cartridge body and said a least one projection comprises a raised elongate projection, said projection extending from a first portion of the ink cartridge toward an second portion or the ink cartridge.

6. The ink pen of claim 5 wherein the width of said elongate slot adjacent the second portion of the cartridge body is greater than the width of the elongate slot adjacent the first portion of the cartridge body, and the width of the elongate projection adjacent the first portion of the ink cartridge is greater than the width of the elongate projection adjacent the second portion of the ink cartridge.

7. The ink pen of claim 1 containing at least two elongate recesses cooperating with at least two elongate projections located on mutually facing surfaces of the cartridge and cartridge body, the elongate recesses having variable widths varying from first portions thereof to second portions thereof and the elongate projections having variable widths varying from first ends thereof to second ends thereof.

8. The ink pen of claim 1 further comprising a cartridge having a removable cover for refilling the cartridge with ink.

9. The ink pen of claim 1 further comprising a cover containing an ink refilling port.

10. The cartridge body of claim 1 further comprising memory support arms extending from a front surface of the ink cartridge.

11. The cartridge body of claim 10 further comprising a memory device attached to the support arms, for receiving, storing and/or transmitting alignment information, ink information, and the like to a printer control system.

12. A method of replacing an ink cartridge on an ink jet pen, the method comprising the steps of providing a cartridge body having a printhead and a replaceable ink cartridge, the cartridge body and the ink cartridge having at least one cooperating elongate recess, said recess having an axis parallel to the length of the recess, and at least one elongate projection engageable with the elongate recess, said recess and projection being located on mutually facing surfaces of the cartridge body and ink cartridge, wherein said elongate recess has a variable width, the recess width varying from a first portion of said elongate recess to a second portion of said elongate recess, said elongate projection has a variable width, the projection width varying from a first end of said elongate projection to a second end of said elongate projection, and a latch member connected to the ink cartridge for engaging a portion of the cartridge body for maintaining the ink cartridge in the desired position relative to the cartridge body, moving the ink cartridge with respect to the cartridge body in a direction which is, at least initially, parallel to the recess axis in order to engage the recess and the projection and seat the ink cartridge on the cartridge body so that ink within the ink cartridge is in flow communication with the printhead and engaging the latch member with a portion of the cartridge body in order to maintain the ink cartridge in the desired position relative to the cartridge body.

13. The method of claim 12 wherein the cartridge body includes an urging member for urging said latch member in latching engagement with said portion of said cartridge body.

14. The method of claim 12 wherein said at least one recess comprises an elongate slot, said slot extending from a second portion of the cartridge body toward an first portion of the cartridge body and said at least one projection comprises a raised elongate projection, said projection extending from a first portion of the ink cartridge toward an second portion of the ink cartridge.

15. The method of claim 14 wherein the width of said elongate slot adjacent the second portion of the cartridge body is greater than the width of the elongate slot adjacent the first portion of the cartridge body, and the width of the elongate projection adjacent the first portion of the ink cartridge is greater than the width of the elongate projection adjacent the second portion of the ink cartridge.

16. The method of claim 12 wherein the ink cartridge includes a removable cover, further comprising removing the cover from the ink cartridge and refilling the cartridge with ink.

17. The method of claim 12 wherein the ink cartridge includes a cover having an ink fill port, further comprising refilling the ink cartridge with ink by feeding ink thereto through the ink fill port.

18. The method of claim 12 wherein said at least one recess comprises an elongate slot, said slot extending from a first portion of the ink cartridge toward an second portion of the ink cartridge and said at least one projection comprises a raised elongate projection, said projection extending from a second portion of the cartridge body toward an first portion of the cartridge body.

19. The method of claim 18 wherein the width of said elongate slot adjacent the first portion of the ink cartridge is greater than the width of the elongate slot adjacent the second portion of the ink cartridge, and the width of the elongate projection adjacent the second portion of the cartridge body is greater than the width of the elongate projection of adjacent the first portion of the cartridge body.

20. The method of claim 12 wherein the ink cartridge contains memory support arms extending from a front surface of the ink cartridge.

21. The method of claim 20 wherein the memory support arms contain a memory device attached thereto for receiving, scoring and/or transmitting alignment information, ink information, and the like to a printer control system upon replacement of the ink cartridge.

* * * * *